US005695869A

United States Patent [19]

Auerbach et al.

[11] Patent Number: 5,695,869

[45] Date of Patent: Dec. 9, 1997

[54] MELT-BLOWN POLYARYLENE SULFIDE MICROFIBERS AND METHOD OF MAKING THE SAME

[75] Inventors: Andrew Bernard Auerbach, Livingston, N.J.; Warren Stephen Harmon, Charlotte, N.C.

[73] Assignee: Hoechst Celanese Corporation, Somerville, N.J.

[21] Appl. No.: 517,494

[22] Filed: Aug. 21, 1995

Related U.S. Application Data

[63] Continuation-in-part of Ser. No. 324,946, Oct. 18, 1994, abandoned.

[51] Int. Cl.[6] ..... D04H 1/58; B29B 9/00

[52] U.S. Cl. ..... 428/288; 264/13; 264/14; 264/211; 264/211.2; 428/296; 428/903; 524/120; 524/126; 524/127; 524/128; 524/151; 524/153; 524/609

[58] Field of Search ..... 524/127, 151, 524/153, 126, 609, 120, 128; 264/13, 14, 211, 211.2; 428/288, 296, 903

[56] References Cited

U.S. PATENT DOCUMENTS

| | | | |
|---|---|---|---|
| 3,959,421 | 5/1976 | Weber | 264/13 |
| 4,104,340 | 8/1978 | Ward | 264/13 |
| 4,187,212 | 2/1980 | Zinke et al. | 260/45.8 NT |
| 4,411,853 | 10/1983 | Reed et al. | 264/211 |
| 4,434,122 | 2/1984 | Reed et al. | 264/211 |
| 4,454,189 | 6/1984 | Fukata | 428/224 |
| 4,763,638 | 8/1988 | Bier et al. | 524/609 |
| 4,892,930 | 1/1990 | Liang | 524/609 |
| 4,898,904 | 2/1990 | Yu et al. | 524/609 |
| 4,950,529 | 8/1990 | Ikeda et al. | 428/224 |
| 5,075,161 | 12/1991 | Nyssen et al. | 428/288 |
| 5,185,392 | 2/1993 | Nonaka et al. | 524/609 |
| 5,232,770 | 8/1993 | Joseph | 428/284 |
| 5,246,647 | 9/1993 | Beck et al. | 264/41 |

OTHER PUBLICATIONS

Database WPI Section Ch, Week 9018 Derwent Publications Ltd., London, GB; Class A26, AN 90–134630 & JP–A–02 080 651(Teijin KK), 20 Mar. 1990 *Abstract*.

Database WPI Section Ch, Week 8832 Derwent Publications Ltd., London, GB; Class A26, AN 88–224324 & JP–A–63 159 470 (Idemitsu Petrochem KK), 2 Jul. 1988 *Abstract*.

*Primary Examiner*—Veronica P. Hoke

[57] ABSTRACT

Melt-blown microfiber webs are prepared from polyarylene sulfide polymers, particularly polyphenylene sulfide. A small amount of a phosphite or phosphonite compound is added to the extruder feedstock. The additive essentially eliminates spurious polymer particle formation at the extruder die openings, even over sustained production periods. The polyarylene sulfide microfiber webs so produced are thus essentially free of spurious particulates, and the web defects which may be caused by such particulates.

15 Claims, 2 Drawing Sheets

MELT-BLOWN POLYARYLENE SULFIDE MICROFIBERS AND METHOD OF MAKING THE SAME

This is a continuation-in-part of application(s) Ser. No. 08/324,946 filed on Oct. 18, 1994 now abandoned.

FIELD OF THE INVENTION

The invention relates to the production of microfibers more particularly microfibers formed by melt-blowing polyarylene sulfide resins.

BACKGROUND OF THE INVENTION

Historically, the oldest chemical-to-fabric route is melt-blowing. Melt-blowing results in microdenier fibers with diameters of 0.1–20 μm, and more typically in the 0.5–7 μm range of typically continuous filaments. Melt-blown fibers are an order of magnitude smaller than the smallest spunbonded fiber.

The melt-blowing process consists of extruding the fiber-forming polymer through a linear array of single-extrusion orifices directly into a high velocity heated air stream. The rapidly moving hot air greatly attenuates the fibers as they leave the orifices, creating the subdenier size.

The die tip is designed in such a way that the holes are in a straight line with high velocity air impinging from each side. A typical die will have 10–20 mil (0.25–0.51 mm) diameter holes spaced at 20 to 50 per inch. The impinging high-velocity hot air attenuates the filaments and forms the desired microfibers. Typical air conditions range from 400° to 700° F. (204° to 371° C.) at velocities of 0.5 to 0.8 mach 1, and higher. Immediately around the die, a large amount of ambient air is drawn into the hot air stream containing the microfibers. The ambient air cools the hot gas and solidifies the fibers.

The discontinuous fibers may be deposited on a conveyor or takeup screen as a random, entangled web. Under the proper conditions, the fibers will still be somewhat soft at laydown and will tend to form fiber-fiber bonds—that is, they will stick together. The combination of fiber entanglement and fiber-to-fiber cohesion generally produces enough entanglement so that the web can be handled without further bonding. The web may also be deposited onto a conventional spun but not bonded web to which the former is then thermally bonded. Sandwich structures may be created with a melt-blown web between two conventional spunbonded webs. Sandwich structures may also be created with a melt-blown web between two layers of woven fabrics or other types of non-woven fabrics.

The large quantity of very fine fibers in a melt-blown web results in a nonwoven fabric having a large surface area and very small pore sizes. Fabrics formed from melt-blown webs therefore find use as battery separators, oil absorbers, filter media, hospital-medical products, insulation batting, and the like. Filter media from melt-blown nonwoven webs may be used to capture fine particles from a gas or liquid stream.

Polyarylene sulfides, and polyphenylene sulfide (PPS) in particular, comprise a group of thermoplastic polymers having highly desirable properties such as chemical resistance, heat resistance, wet heat resistance and fire retardance. However, PPS resin suffers from several significant adverse qualities which make production of PPS nonwoven webs highly problematic on a commercial scale. The high temperature and high velocities of the melt-blowing process may give rise to polymer oxidation. As the melt blowing process proceeds, grain-sized resin particles known in the art as "shot" accumulate at the die opening and may be blown into the forming web. Larger resin aggregates known as "spitters" may also form at the die opening or on the extruder air lips. These larger, hard particles represent polymer aggregates or pieces of truncated fiber. They may break away from the die and be propelled into the forming web during the melt-blow process, creating defects in the web. If these extraneous particles are large enough, they can interfere with the subsequent processing of the web material. For example, where the web is employed as a filtration layer in a needle-punched felt, the microfiber web could cause needle damage or even breakage from impact with the hard resin aggregates.

These difficulties in the melt-blowing of polyarylene sulfides have prevented commercial scale production of nonwoven PPS microfiber products. What is needed is a process useful for melt-blowing of polyarylene sulfides, and PPS in particular, which avoids polymer oxidation and the formation of spitters and shot. What is needed is a process capable of sustained, efficient melt-blowing of defect-free nonwoven PPS web under commercial scale production conditions.

SUMMARY OF THE INVENTION

A process for preparing filaments of a polyarylene sulfide is provided. A mixture comprising a polyarylene Sulfide polymer and an organic phosphite or phosphonite additive of the formula (1), (2), (3) or (4):

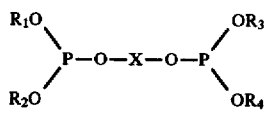
(1)

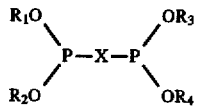
(2)

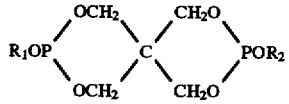
(3)

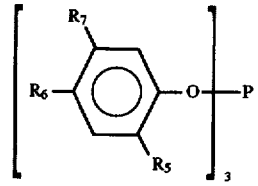
(4)

wherein $R_1$, $R_2$, $R_3$ and $R_4$, which may be the same or different, are each selected from the group consisting of alkyl, substituted alkyl, aryl, substituted aryl and alkoxy, and X is alkylene, substituted alkylene, arylene or substituted arylene, $R_5$ is selected from the group consisting of t-butyl,1,1-dimethylpropyl, cyclohexyl and phenyl, and one of $R_6$ and $R_7$ is hydrogen and the other is selected from the group consisting of methyl, t-butyl, 1,1-dimethylpropyl, cyclohexyl and phenyl, is extruded through a plurality of orifices at a temperature higher than the melting temperature of the polyarylene sulfide polymer, into a stream of high-velocity air. The extruded filaments are then collected.

The invention further comprises melt-blown microfibers prepared according to the aforesaid process, melt-blown microfiber webs containing such microfibers, and multilayer fabric constructions containing such a web as a component.

DETAILED DESCRIPTION OF THE INVENTION

Figure 1:
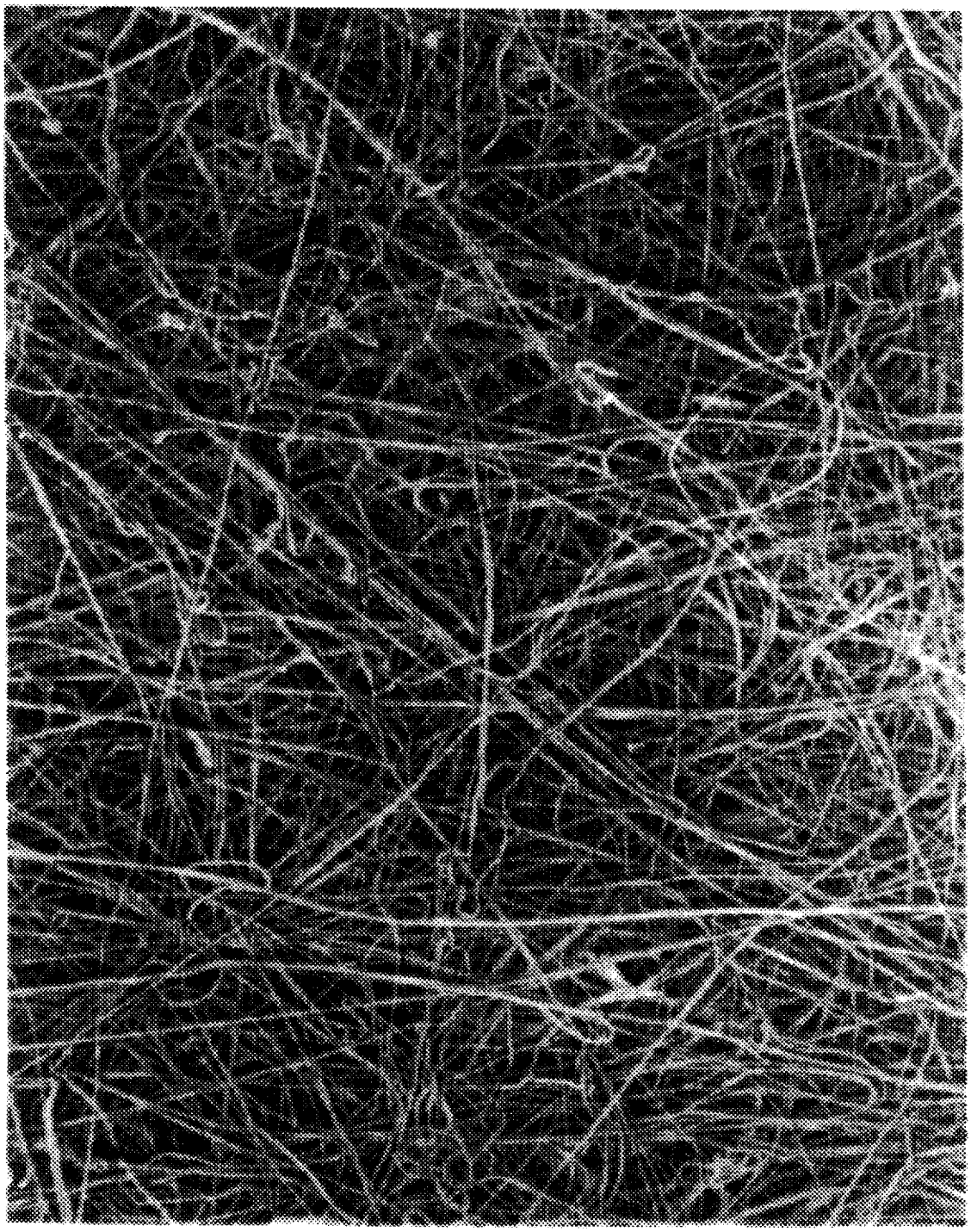
FIG. 1 is a 75× micrograph of a melt-blown PPS web produced with an organic bisphosphite as a processing additive, according to the practice of the present invention.

According to the present invention, melt-blown polyarylene sulfide microfibers are produced by a sustained process capable of continuous operation without the formation of significant amounts of spurious particulate matter.

A polyarylene sulfide polymer is combined with an organic phosphite or phosphonite, heated to a temperature above the melting point of the polymer, and extruded in a conventional melt-blowing apparatus. The extrudate is conveyed by a high velocity air stream which attenuates the resulting fibers to microfiber diameter, e.g. 0.1–5 μm. The presence of the organic phosphite/phosphonite has led to the surprising result that, under optimized process conditions, little or no spitters and shot are produced, even after sustained extruder operation extending over periods of many hours. Moreover, nonwoven webs and fabrics formed with the resulting microfibers possess the desirable performance characteristics of polyarylene sulfide materials.

The base material in the process of the present invention is a polyarylene sulfide polymer comprising the repeating unit —(Ar—S—)—, wherein Ar is a substituted or unsubstituted arylene group. The arylene group may comprise, for example, p-phenylene, m-phenylene, o-phenylene, a substituted phenylene (5),

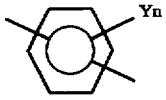

(5)

wherein $Y_n$ is alkyl, preferably $C_1$–$C_6$ alkyl, or phenyl, and n is an integer of 1 to 4, p,p'-diphenylene sulfone, p,p'-biphenylene, p,p'-diphenylene ether, p,p'-diphenylene carbonyl, and a naphthalene (6)

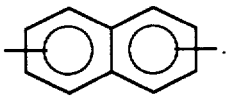

(6)

According to a preferred embodiment of the invention, the polyarylene sulfide is PPS.

The polyarylene sulfide may comprise a homopolymer or copolymer (inclusive of terpolymers and higher polymers) of polyarylene sulfide units. Thus, the expression "polyarylene sulfide" as used herein includes not only homopolymers of arylene sulfide units, but also copolymers including such units. By the same token, "polyphenylene sulfide" includes not only homopolymers of phenylene sulfide units, but also copolymers including phenylene sulfide units. The polyarylene sulfide may be cross-linked. It is preferably linear.

Copolymers may comprise two or more different arylene sulfide units, such as p-phenylene sulfide and m-phenylene sulfide. In a preferred embodiment of the invention, the polyarylene sulfide is a substantially linear homopolymer comprising p-phenylene sulfide as the repeating unit, or a copolymer comprising at least about 50 mol %, more preferably at least about 70 mol %, p-phenylene sulfide units. The comonomer is preferably m-phenylene sulfide.

The polyarylene sulfide polymer for use in the practice of the present invention advantageously has a melt viscosity of from about 100 to about 1000 poise, more preferably from about 100 to about 500 poise, most preferably from about 200 to about 400 poise. The melt viscosities have been determined by use of a KAYNESS GALAXY Capillary Rheometer, model D 8052 at 310° C. and a shear rate of 1200 $sec^{-1}$. The salient operating parameters of the device include a charging time of 1 minure, a dwell time of 400 seconds, an orifice radius of 0.02 inches, an orifice length of 0.60 inches, and an L/D ratio of 15:1. If the viscosity is too high, air attenuation of the extruded fibers becomes impractical. If the viscosity is too low, insufficient back pressure is generated to support extrusion. Commercially available polyarylene sulfide polymers within the acceptable viscosity range include, for example, Fortron® PPS grade W203 and W205 powder, available from Hoechst Celanese, Summit N.J., and Phillips Petroleum RYTON® PPS grade P-6 powder.

The organic phosphite or phosphonite may comprise any compound within the scope of formulas (1)–(4), above. Each of the substituted alkyl, aryl, alkylene or arylene groups comprising $R_1$ through $R_4$ or X may be monosubstituted, or may have more than one substituent. $R_1$ to $R_4$ are preferably alkyl containing five or more carbon atoms, substituted alkyl, aryl or substituted aryl. Alkyl containing ten or more carbon atoms, alkoxy, aryl and substituted aryl are particularly preferred. Representative compounds of formulae (1)–(3) include the following compounds and groups of compound (7)–(14) as PPS molding additives in U.S. Pat. No. 5,185,392, the entire disclosure of which is incorporated herein by reference:

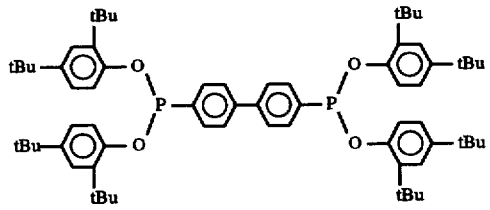

(7)

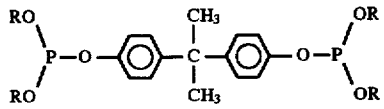

(8)

wherein R=$C_{12}$–$C_{15}$ alkyl

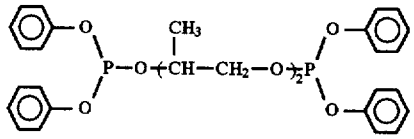

(9)

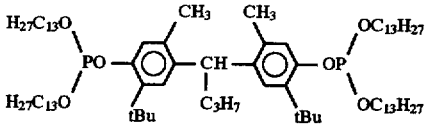

(10)

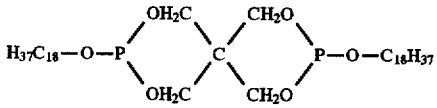

(11)

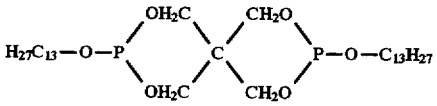

(12)

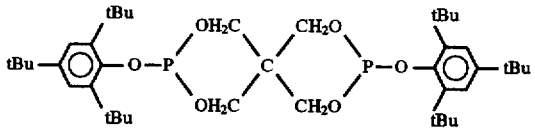

(13)

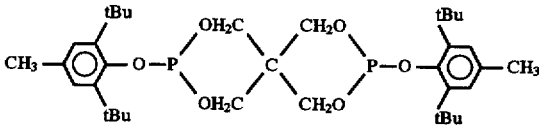

(14)

Preferably, the additive is a bisphosphite according to formula (3)

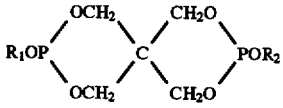

(3)

wherein $R_1$, $R_2$, $R_3$ and $R_4$, which may be the same or different, are each selected from the group consisting of alkyl, substituted alkyl, aryl, substituted aryl and alkoxy, and X is alkylene, substituted alkylene, arylene or substituted arylene. One such particularly preferred compound is bis(2,4-di-t-butylphenyl)pentaerythritol diphosphite:

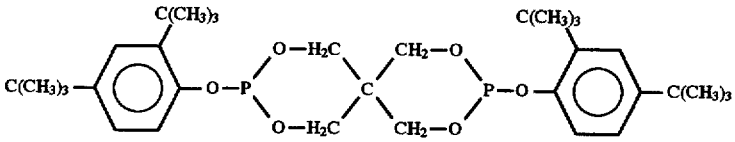

(15)

A preferred phosphite according to formula (4)

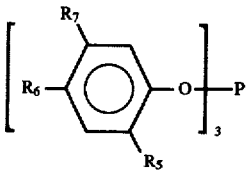

(4)

is tris(2,4-di-t-butylphenyl)phosphite. Hence, preferred phosphites include, but are not limited to, ULTRANOX® 626 by G. E. Speciality Chemicals, Inc., WESTON® 618, by G. E. Specialty Chemicals, Inc.,IRGAFOS® 168, by CIBA-GEIGY, and Sandostab® P-EPG by Sandoz.

The polyarylene sulfide resin and the organic phosphite/phosphonite compound are advantageously premixed prior to extrusion in the melt-blowing apparatus. While the extruder feedstock may comprise material in any physical form such as powder, pellets chips or flakes, pelleted and chip material is preferred for its ease of handling. According to one preferred embodiment, the polyarylene sulfide in powder or powdered form is compounded with the phosphite/phosphonite into pellets of convenient size. Compounding also ensures uniform mixing of the resin and additive. Compounding may advantageously take the form of extrusion of the resin and additive together, followed by pelletizing. Lower viscosity materials, e.g., a 300 poise polyarylene sulfide, may require the use of relatively small diameter extrusion orifices to generate the back pressure necessary for extrusion compounding. A twin screw extruder is preferred for such materials. The pellets may be optionally crystallized, such as by heat treatment at from about 100° to about 140° C., for from about one hour to about 24 hours.

The amount of the phosphite/phosphonite compound in the mixture may advantageously vary from about 0.1 to about 5%, preferably from about 0.4 to about 2%, most preferably from about 0.8 to about 1.6%. One percent is believed optimum. These percentages comprise weight percentages, prior to compounding.

The mixture of polyarylene sulfide resin and phosphite/phosphonite compound may include optional additives such as delusterants, whiteners, drawing aids, lubricants, stabilizers and rheological modifiers. Titanium dioxide is one such optional additive. It functions as a delusterant, whitener and drawing aid. The use of fillers is not contemplated, as filled materials are incompatible with the melt-blowing process.

The melt-blowing feedstock is loaded into a conventional melt-blowing apparatus and extruded in the ordinary manner. A typical melt-blowing device is pictured, for example, in U.S. Pat. No. 4,970,529, the entire disclosure of which is incorporated herein by reference. The feedstock is melted in the extruder portion of the apparatus and fed to a die. The molten polymer is then extruded from a plurality of spinning orifices typically arranged in a straight line on a spinneret. A heated high pressure gas, typically air, is simultaneously injected at high velocity through slits arrange on both sides of the orifices to blow streams of molten polymer. The molten polymer is drawn, thinned and set to the shape of a microfiber by the action of the moving gas stream. The fibers are collected on a screen circulating between a pair of rollers to form a random web.

The temperature selected for the extrusion depends upon the melting temperature of the particular polyarylene sulfide polymer employed. For very low viscosity polymers, the extruder temperature may only need to be slightly higher than the polymer melting point. Typically, the extrusion temperature will be from about 20° to about 65° C. above the polymer melting point, measured just before the material exits the dye. It is desired that the extrusion temperature is high enough to melt the polyarylene sulfide polymer, but not high enough to induce significant degradation of the polymer while being extruded. Also, the extrusion temperature will determine the diameter of the resulting microfibers. Higher extrusion temperatures result in smaller diameter fibers; lower temperatures result in larger diameter fibers.

The extrusion through-put, the rate at which material is extruded per orifice unit area, may be adjusted as desired. Preferably, the through-put is as high as possible in order to maximize production. Through-put is dependent on a number of factors, including the number and size of orifices. For example, for a spinneret containing 25 orifices measuring 15 mil (0.38 mm) in diameter, an extrusion rate of about 1–4 g/min./hole may be used.

The extrusion feedstock is preferably held under a blanket of inert gas during the extrusion process. Nitrogen, argon, or any other inert gas may be used. Moreover, the feedstock should be dried before extrusion, as polyarylene sulfides are subject to moisture regain.

The extruded filaments are collected on a conveyor or take-up screen to form a continuous melt-blown microfiber web useful as a non-woven fabric. For some applications, the web can be a layer in a composite multi-layer structure. The other layers can be supporting webs, film (such as elastic films, semi-permeable films or impermeable films). Other layers could be used for purposes such as absorbency, surface texture, rigidification and can be non-woven webs formed of, for example, staple, spunbond and/or melt-blown fibers. The other layers can be attached to the polyarylene sulfide melt-blown web of the present invention by conventional techniques such as heat bonding, binders or adhesives, or by mechanical engagement, such as hydroentanglement or needle punching. Other structures could also be included in a composite structure, such as reinforcing or elastic threads or strands, which would preferably be sandwiched between two layers of the composite structures. These strands or threads can likewise be attached by the conventional methods described above.

Webs, or composite structures including webs according to the present invention, can be further processed after collection or assembly such as by calendering or point embossing to increase web strength, provide a patterned surface, and fuse fibers at contact points in a web structure or the like; orientation to provide increased web strength; needle punching; heat or molding operations; coating, such as with adhesives to provide a tape structure; or the like.

According to one embodiment, the inventive web forms a layer in a needle-punched felt fabric comprising one or more staple carded web layers and one or more melt-blown micro-fiber web layers prepared substantially in accordance with the present invention. The needle-punched felt may further comprise one or more woven scrim layers. The multi-layer composite structure is needle-punched in the conventional manner. Suitable staple carded web for this purpose may be prepared from PPS or other synthetic or natural fibers capable of carding.

The practice of the invention is illustrated by the following non-limiting examples.

EXAMPLE 1

Laboratory-Scale Comparative Study

The additives identified in Tables 1 and 2 below were compounded into FORTRON® grade W203 powder PPS (300 poise) by mixing in a Henschel mixer in a 9:1 PPS:additive weight ratio. The mixture was then fed into a 30 mm ZSK twin screw extruder heated to 310° C. (flat profile; melt temperature 325° C.) and extruded at a screw speed of 100 rpm and a vacuum of 25 inches. The extrudate was pelletized and dried to form a PPS+additive concentrate. Each concentrate was then mixed with pelletized and crystallized FORTRON® grade W203 PPS under an argon blanket to form a melt-blowing feedstock containing the net additive loadings indicated in Tables 1 and 2. One feedstock received no additive. Each of the feedstocks was melt-blown on a continuous basis using a laboratory scale melt-blowing apparatus having a six inch spinneret producing a six inch wide web. Die nose pieces had either 0.015 or 0.020 inch diameter holes, with 20 holes per inch. Before each run, a clean die piece was installed and the system was stabilized with No. 35 melt-flow polypropylene before introduction of the feedstock. For the run containing no additive, the melt-blowing air attenuation temperature was 307°–309° C., the die temperature was in the 321°–324° C. range, and the extruder through-put was estimated at about 8 lbs/hour. For other runs, differences in the viscosity of the various additives led to deviations in through-put. Air attenuation temperatures varied from 313° C. to 326° C. Outside die temperatures varied from 313° C. to 321° C. For the trial of the silica additive, a PPS variant base polymer was used, containing 0.35 wt % silane. The time to the formation of spitters was recorded. The results appear in Tables 1 and 2.

TABLE 1

| Run | Additive | Additive Net Loading (wt. %) | Time to Spitters (min.) |
|---|---|---|---|
| 1 | — | — | 54 |
| 2 | silicone oil, 5000 cs | 1.0 | 3–6 |
| 3 | silicone oil, 5000 cs | 5.0 | 50–56 |
| 4 | $TiO_2$ | 0.3 | 90 |
| 5 | silica (Cab-O-Sil TS-720) | 1.0 | 6.0 |

TABLE 2

| Run | Additive | Additive Net Loading (wt. %) | Time to Spitters (min.) |
|---|---|---|---|
| A | $TiO_2$ | 1.00 | 14[1] |
| B | BDBPD[2] | 0.65 | terminated[3] |
| C | " | 0.20 | 71[4] |
| D | " | 0.40 | 52[5] |
| E | " | 0.80 | 163[6] |
| F | BDBPD | 0.80 | 20[8] |
| | PVDF/HFP copolymer[7] | 0.50 | |
| G | calcium stearate | 0.40 | terminated[9] |
| H | calcium stearate | 0.40 | 73[10] |
| I | BDBPD | 0.80 | 171[11] |
| | $TiO_2$ | 0.30 | |

Notes:
[1]Much shot early.
[2]Bis (2,4-di-t-butylphenyl)pentaerythritol diphosphite.
[3]Run terminated at 12 min. due to equipment failure. No spitters.
[4]Repeat spitters, but die leaks observed which may have contributed to generation of spitters.
[5]Minimal spitters.
[6]Only occasional spitters.
[7]Polyvinylidene flouride/hexafluoropropylene copolymer (KYNAR ® 2800, Elf Atochem North America, Inc.)
[8]Many spitters and shot.
[9]Die failure. Trial terminated.
[10]Much shot and spitters in many die locations.
[11]Only occasional spitters.

While titanium dioxide had some effect in reducing die deposits and the formation of spitters, it did not eliminate the problem. Bis(2,4-di-t-butylphenyl)pentaerythritol diphosphite (BDBPD) was the only additive which was successful in substantially eliminating the formation of deposits at the die orifice and the creation of spitters and shot. Runs D, E and I, which utilized BDBPD as an additive, generated only occasional spitters. These runs were terminated after approximately 2–4 hours. Production remained stable and could have been continued beyond the allotted 2–4 run time.

EXAMPLE 2

Approximately 3196 lbs of FORTRON® grade W203 PPS was compounded with 1.0 wt. % bis(2,4-di-t-butylphenyl)pentaerythritol diphosphite into pellets. Compounding was carried out on a 72 mm ZSK twin screw extruder, with a temperature profile from 316° to 327° C., a screw speed of 100 rpm, and 25 inches of vacuum. The pellets were then crystallized by heating at 120° C. for three hours. The crystallized pellets were dried at 121° C. (250° F.) for 8 hours and maintained under a nitrogen blanket until extruded. The pelletized polymer, which displayed a melt viscosity of 268.0 poise, was loaded into a production scale melt-blowing apparatus having a 64 inch spinneret head. The apparatus was previously purged with type 35 melt flow polypropylene. The feedstock was continuously melt-blown until exhausted. The extrusion temperature of the PPS polymer was 310° C. (590° F.). The extruded filaments were attenuated in an air stream at 335° C. (635° F.) with an air velocity of 26,000 ft/minute. The line production rate was 150 lb/hour. The process remained stable with no pressure rise, die face contamination or web defects (spitters or shot) for over 13 hours at this production rate. Between 13 hours and the 20 hours (the end of the trial) some minor spitters and shot formed which was kept to an acceptable level by periodic die face and air lip maintenance including wiping, scraping and silicone spraying of the metal surfaces. All feedstock was successfully processed into 4840 yards (1950 lbs) of Q1 web, based on pairing 56 inch and 30 inch wide rolls together for felt development (85 inches total width with 1 inch overlap). A 75× micrograph of the web is shown in FIG. 1. The web properties were as follows:

Basis Weight (ASTM D3776): 2.42 oz/yd$^2$

Air Permeability (ASTM D737): 69.6 scfm

Thickness (ASTM D1777): 33 mils

Elmendorf Tear (ASTM D1424): 438 g/ply

Mullen Burst 5.72 lbs

Bubble Point (ASTM E128): 7.7 in. $H_2O$

COMPARATIVE EXAMPLE 2

Figure 2:
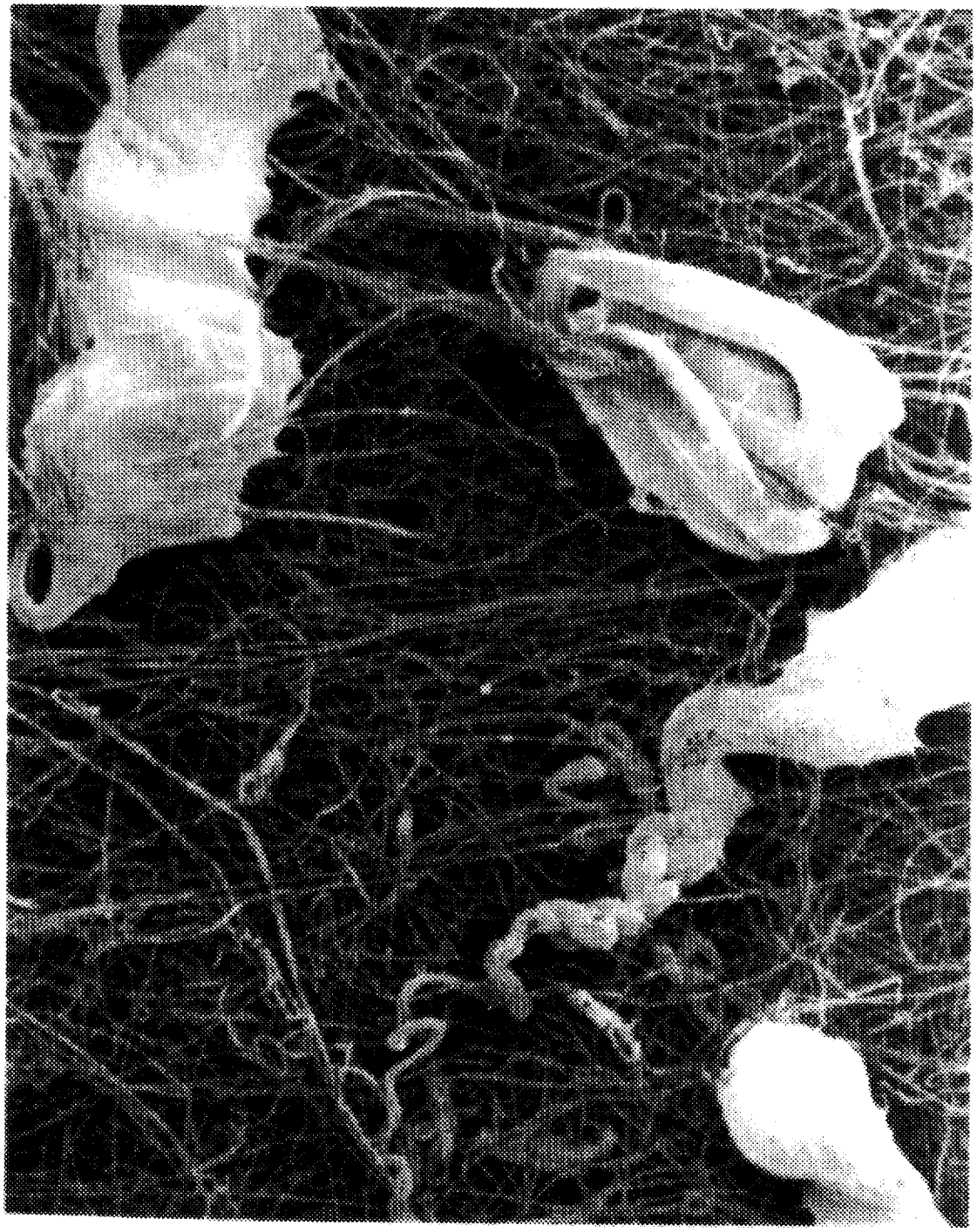
FIG. 2 is a 75× micrograph, similar to FIG. 1, of a melt-blown PPS web produced without an organic bisphosphite processing additive.

A production run similar to Example 1 was attempted on the same apparatus but with PPS only. No bis(2,4-di-t-butylphenyl)pentaerythritol diphosphite was added to the feedstock. Spitters appeared after about 80 minutes of continuous operation. The process run was interrupted at this point to clean the die holes and nose piece with silicon mold release. The process was then restarted. Spitters reappeared at a noticeable level 55 minutes later. Spitters continued occurring with increasing frequency and size to an unacceptable level and that at 120 minutes post-restart the trial was terminated. The resulting web could not be needle-punched due to the size and number of spitters contained in the web. A 75× micrograph of the web (FIG. 2) shows these bodies, which are absent from the web produced with the aid of the bis(2,4-di-t-butylphenyl)pentaerythritol diphosphite additive (FIG. 1).

EXAMPLE 3

The additives identified in Table 3 below were compounded into FORTRON® grade W203 flake PPS as per the previous procedure described in Example 1 by mixing in a Henschel mixer in a 9:1 PPS:additive weight ratio. The mixture was then fed into a 30 mm twin screw extruder heated to 310° C. and extruded. The extrudate was pelletized and dried to form a PPS+additive concentrate. These concentrates were then mixed with FORTRON® W203 which had been pelletized. The feedstocks were melt blown on a continuous basis using a laboratory melt blowing apparatus having a six inch spinneret producing a six inch wide web as in Example 1. The final concentration of the additives in the web was nominally 1%. Air attenuation temperatures were in the range of 313°–326° C., while extruder die temperatures varied 313° to 321° C. All trials were run until the time to the formation of spitters. The data for the time to spitter formation was recorded, and the results appear in Table 3.

A melt stability test was used to determine any improvements in PPS melt stability that would be obtainable with the use of antioxidants. The data for the melt stability of PPS in the presence of these antioxidants is listed in Table 3. The melt stability test was performed on a KAYENESS GALAXY 5 Rheometer at 310° C. using a preprogrammed module which allows readings to be taken of viscosity versus time (five minute intervals for thirty minutes total) at a constant shear rate of 400 sec$^{-1}$. The test was performed with a rheometer die with a 0.04 inch diameter orifice, 0.6 inches in length, and a shaft ram rate of 1.36 in/min. The PPS was added to the barrel of the rheometer and was allowed to sit in the barrel for five minutes before testing was initiated. After five minutes had passed, a program in the rheometer automatically initiated a sequence which tested the sample every five minutes at a constant shear rate and stored the viscosity readings in a computer. At the end of the sequence the data was retrieved and was analyzed by regression analysis. The degradation rate was calculated from the first addition of the sample, and a figure was obtained that reflects the loss in viscosity per minute.

It was found that PPS formulations containing IRGAFOS® 168 were equal to those containing WESTON® 618 and ULTRANOX® 626 in melt stability. This is in contrast to the superior improvements in melt blown web processability with the use of WESTON® 618 and ULTRANOX® 626 versus IRGAFOS® 168. The data in Table 3 clearly indicates the positive effects of WESTON® 618 and ULTRANOX® 626 as compared to IRGAFOS® 168 in improving melt processability (i.e. time to spitters). It suggests that antioxidant effectiveness alone is not sufficient to allow for the prediction of processing improvements.

TABLE 3

| Run | Additive | Additive Net Loading (wt. %) | Time to Spitters (min.) | Melt Viscosity Stability @ 320° C. (%/min) |
|---|---|---|---|---|
| A1 | WESTON ® 618[1] | 1 | no spitters @ 273 min. | 0.75 |
| B1 | IRGAFOS ® 168[2] | 1 | 70 | 0.71 |
| C1 | Sandostab-EPQ[3] | 1 | 165 | 0.89 |

[1]Distearyl pentaerythritol diphosphite.
[2]Tris(2,4-di-tert-butylphenyl) phosphite.
[3]Tetrakis(2,4-di-tert-butyl phenyl) 4,4'-biphenylylene diphosphonite.

All references cited with respect to synthetic, preparative and analytical procedures are incorporated herein by reference.

The present invention may be embodied in other specific forms without departing from the spirit or essential attributes thereof and, accordingly, reference should be made to the appended claims, rather than to the foregoing specification, as indication the scope of the invention.

We claim:

1. A process for preparing filaments of a polyarylene sulfide comprising extruding a mixture comprising a polyarylene sulfide polymer and an organic phosphite or phosphonite additive of the formula (1), (2), (3) or (4):

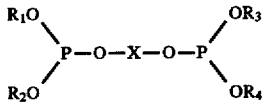

(1)

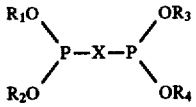

(2)

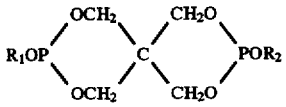

(3)

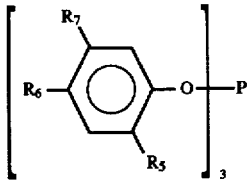

(4)

wherein $R_1$, $R_2$, $R_3$ and $R_4$, which may be the same or different, are each selected from the group consisting of alkyl, substituted alkyl, aryl, substituted aryl and alkoxy, and X is alkylene, substituted alkylene, arylene or substituted arylene, $R_5$ is selected from the group consisting of t-butyl,1,1-dimethylpropyl, cyclohexyl and phenyl, and one of $R_6$ and $R_7$ is hydrogen and the other is selected from the group consisting of methyl, t-butyl, 1,1-dimethylpropyl, cyclohexyl and phenyl, through a plurality of orifices at a temperature higher than the melting temperature of the polyarylene sulfide polymer, into a stream of high-velocity air, and collecting the extruded filaments.

2. A process according to claim 1 wherein the polyarylene sulfide is polyphenylene sulfide.

3. A process according to claim 2 wherein the additive is a diphosphite according to formula (3)

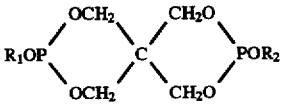

(3)

wherein $R_1$ and $R_2$ which may be the same or different, are each selected from the group conisiting of alkyl, substituted alkyl, aryl, substituted aryl and alkoxy, and X is alkylene, substituted alkylene, arylene or substituted arylene.

4. A process according to claim 3 wherein the diphosphite is bis(2,4-di-t-butylphenyl)pentaerythritol diphosphite.

5. A process according to claim 1 wherein the polyphenylene sulfide has a melt viscosity of from about 100 to about 1000 poise, measured at a temperature of 310° C. and a shear rate of 1200 $sec^{-1}$.

6. A process according to claim 5 wherein the polyphenylene sulfide has a melt viscosity of from about 100 to about 500 poise, measured at a temperature of 310° C. and a shear rate of 1200 $sec^{-1}$.

7. A process according to claim 6 wherein the polyphenylene sulfide has a melt viscosity of from about 200 to about 400 poise.

8. A process according to claim 1 wherein the additive is present in the mixture comprising the polyphenylene sulfide and phosphite or phosphonite, before compounding of said mixture, in the amount of from about 0.1 to about 5%, by weight of said mixture.

9. A process according to claim 8 wherein the additive is present in the mixture comprising the polyphenylene sulfide and phosphite or phosphonite, before compounding of said mixture, in the amount of from about 0.4 to about 2%, by weight of said mixture.

10. A process according to claim 9 wherein the additive is present in the mixture comprising the polyphenylene sulfide and phosphite or phosphonite, before compounding of said mixture, in the amount of from about 0.8 to about 1.6% by weight of said mixture.

11. A process according to claim 2 wherein the mixture comprises, before compounding, from about 0.8 to about 1.6 wt % bis (2,4-di-t-butylphenyl) pentaerythritol disphosphite, and the polyphenylene sulfide has a melt viscosity of from about 200 to about 400 poise, measured at a temperature of 310° C. and a shear rate of 1200 $sec^{-1}$.

12. A melt-blown microfiber web prepared according to the process of claim 1.

13. A filtration medium comprising a melt-blown microfiber web prepared according to the process of claim 1.

14. A needle-punched felt comprising:

(a) at least one staple carded web layer; and (b) at least one melt-blown microfiber web layer prepared according to the process of claim 1.

15. A needle-punched felt according to claim 14 further comprising:

(c) at least one woven scrim layer.

* * * * *